US005994635A

United States Patent [19]

Hoshino

[11] Patent Number: 5,994,635

[45] Date of Patent: Nov. 30, 1999

[54] CONNECTING STRUCTURE FOR THE SEPARABLE PART OF A DUAL DRUM PEDAL

[75] Inventor: Yoshihiro Hoshino, Nagoya, Japan

[73] Assignee: Hoshino Gakki Kabushiki Kaisha, Japan

[21] Appl. No.: 09/152,648

[22] Filed: Sep. 14, 1998

[30] Foreign Application Priority Data

Jan. 21, 1998 [JP] Japan ..... 10-025051

[51] Int. Cl.[6] ..... G10D 13/02

[52] U.S. Cl. ..... 84/422.1

[58] Field of Search ..... 84/422.1, 422.2

[56] References Cited

U.S. PATENT DOCUMENTS 5,379,674 1/1995 Hoshino ..... 84/422.1

5,388,494 2/1995 Hoshino ..... 84/422.1

*Primary Examiner*—Jeffrey Donels

*Attorney, Agent, or Firm*—Ostrolenk, Faber, Gerb & Soffen, LLP

[57] ABSTRACT

A connecting structure for connecting an inner and an outer rod wherein at least one and more typically two screws at circumferentially spaced apart locations attach the inner and outer rods. An elastic seating plate has an insertion opening in from one side edge followed by a compressive enveloping opening therein which envelopes each of the screws and is also positioned radially outward of the outer rod, so that when the screws are released from the outer rod, they do not fall away from the seating plate. This also prevents idling of the screws. The connecting structure is usable on a drum pedal where a remote pedal is operated for operating a drum beater through a connecting rod on which there is at least one of the connecting structures.

10 Claims, 8 Drawing Sheets

CONNECTING STRUCTURE FOR THE SEPARABLE PART OF A DUAL DRUM PEDAL

BACKGROUND OF THE INVENTION

The present invention relates to a dual drum pedal and particularly to the connecting structure between the separable parts of the dual drum pedal.

PRIOR ART EMBODIMENT

FIGS. 7–10 show a prior art embodiment of a dual drum pedal. A dual drum pedal P1 includes two drum head beaters 12 and 22, which are respectively operated by the right and left feet of a performer, for beating a single bass drum D. Both beaters 12 and 22 are supported for swinging on the frame 11 of the first pedal 10. A rotary shaft 23 on which the second beater 22 is supported for rotation is provided on the frame 11 of the first pedal 10. The rotary shaft 13 for the first beater 12 is also provided on the frame 11. The rotary shaft 23 is connected with the operating shaft 28. The shaft 28 is rotatably operated by the second pedal 20 which is separate from the said first pedal. A connecting rod 40 joins the shafts 13 and 28. The bass drum D includes a drum head Da, a drum body Db and a drum hoop Dc.

There is a first pedal plate 10A for the performer's right foot. The pedal plate 10A is pivotally supported to the first pedal frame 11. An operating member 14, such as a sprocket, etc. is installed on the first beater rotary shaft 13. A chain, a belt, or the like connects the first pedal plate 10A and the operating member 14. There is an installation member 16 for the first beater 12, a cam 17 for the first beater rotary shaft 13, a return spring 18 provided on the cam 17 and a drum hoop clamp 19.

The second beater rotary shaft 23 for the second beater 22 is also provided on the first pedal 10 and its frame 11. An installation member 24 installs the second beater 22 on the second beater rotary shaft 23. There is a respective cam 25 for the second beater rotary shaft 23. A spring 26 provided on the cam 25 is for restoring its original orientation. A bearing 27 between the shaft 23 for the second beater and the first shaft 13 provides linked integration of the first beater rotary shaft 13 and the second beater rotary shaft 23 in a manner permitting each of them to be freely rotatable in a mutually independent manner.

The second pedal 20 includes a second pedal plate 20A for the performer's left foot, a second pedal frame 21 on which the plate 20A is rotatably supported, a second operating shaft 28 which is rotatably operated by the second pedal plate 20A, an operating member 29, such as a sprocket, etc. for rotating the operating shaft 28 and a chain, belt, etc. 30 for joining the second pedal plate 20A and the operating member 29.

A connecting rod 40 transmits the rotation of the second operating shaft 28, which is caused by operation of the pedal plate 20A of the second pedal 20, to the second beater rotary shaft 23 supported on the first pedal 10. The rod 40 is joined with the operating shaft 28 at one end and with the second beater rotary shaft 23 at the other end through the respective universal joints 45 and 46 at both ends of the rod 40, so that the first pedal 10 and the second pedal 20 may be freely arranged by a performer at any orientation with respect to each other, to be selected by the performer using the pedals. A respective fixing screw 47 links each universal joint 45 and 46 with the respective second beater operating shaft 23 and the operating shaft 28.

The connecting rod 40 ordinarily has a flexible structure which enables the distance and the relative orientations between the first pedal 10 and the second pedal 20 to be set for the convenience of the performer. The connecting rod 40 includes a first rod 41 linked to the universal joint 45 on the side of the first pedal 10 and a second rod 42 linked to the universal joint 46 on the side of the second pedal 20. The rods 41 and 42 are provided in a hollow main pipe 43 so as to slide freely therein. The positions of expansion and contraction of the distance between the pedals are fixed by the fixing screws 44 that have been screwed to both ends of the main pipe 43 and press against the respective pipes 41 and 42 within.

The first pedal 10 and the second pedal 20 are linked together by a linking rod 40 in the dual drum pedal during their use at a performance. But they may have to be separated for storage or transportation. The separation will naturally have to be done at the linking part, and is normally done as shown in either of FIGS. 9 or 10.

In FIG. 9, the fixing screws 47 for both universal joints 45 and 46 on both sides of the linking rod member 40 are loosened, for releasing the union between the second beater rotary shaft 23 of the first pedal 10 and the operating shaft 28 of the second pedal 20 and dividing the pedal into three parts.

FIG. 10 shows the fixing screw 44 for fixing one of the rods of the linking rod member 40, the first rod 41 in the drawings, to the main pipe 43 being loosened, enabling withdrawal of the first rod 41 from the main pipe 43 and dividing the pedal into two parts.

However, the fixing screws 47 and 44 remain screwed on their various respective parts after a separation of the pedals at the connecting rod 40 into two or three parts. Because no load is applied to these fixing screws after the separation of the parts, idling may develop due to vibrations or shocks. For example, loosened fixing screws may drop out due to an impact delivered at the times of shifting or of transportation by a vehicle, etc. Since this type of fixing screw is small in size, they tend to be lost if dropped.

Because the fixing screw is used in fixing the connecting rod 40, which is essential for transmitting the action of the second pedal 20, the possible loss of the fixing screw makes it nearly impossible to carry out a performance with the dual drum pedal.

SUMMARY OF THE INVENTION

This invention has an object of providing a simple structure for preventing idling of the remaining fixing screws at the separating part and for preventing loss of the screws due to their dropping out.

The invention concerns an improvement in the dual drum pedal of the prior art for the purpose of holding the fixing screws used for the connecting rod so that they do not fall free of the part of the drum pedal at which they remain when the drum pedal is separated into parts for storage, transportation, etc. As in the prior art, the dual drum pedal has a first and a second drum beater which are supported on the frame for the first of the pedals, has a second pedal, which is normally supported at a distance from the first pedal on a separate second pedal frame, and has a connecting rod between the second pedal and the second shaft which is rotated by the second pedal for connecting the second shaft to the rotary shaft for the second beater located at the first pedal. Further, when necessary, the two drum pedals should be separated into separate units at least at a connection between one of the drum pedals and the connecting rod between the drum pedals.

There is a connection from the connecting rod between the two drum pedals with the rotary shaft that is connected that is to the second drum beater located at the first pedal frame and with the rotary shaft connected to the second drum pedal and located at the second pedal frame. That connection is obtained by respective fixing screws. There are fixing screws at the connections between the connecting rod and the respective rotary shaft at the second pedal, on the one hand, and the rotary shaft at the second drum beater at the other hand.

The connecting rod between the rotary shaft at the second pedal and the rotary shaft at the second beater is comprised of two separate rod sections with a hollow sleeve or tube around them, wherein the two rod sections can be moved together or apart, shortening or lengthening the rod. There are respective fixing screws at each end of the tube or sleeve and which are tightened against the respective first and second relatively movable rod sections for setting the length of the connecting rod between the second pedal rotary shaft and the second beater rotary shaft. This enables adjustment of the spacing between the second pedal and the second drum beater for the particular performer.

According to the invention, at each of the fixing screws, an idling preventive part or element is provided which is wrapped around the screw at the part where the screw is supported and which remains installed in place between the two elements, i.e. the parts of the connecting rod and the connection between a universal joint and a shaft, where the respective screw is supported.

Other objects and features of the invention are explained below with reference to the accompanying drawings.

DETAILED DESCRIPTION OF EMBODIMENTS OF THE INVENTION

Figure 1:
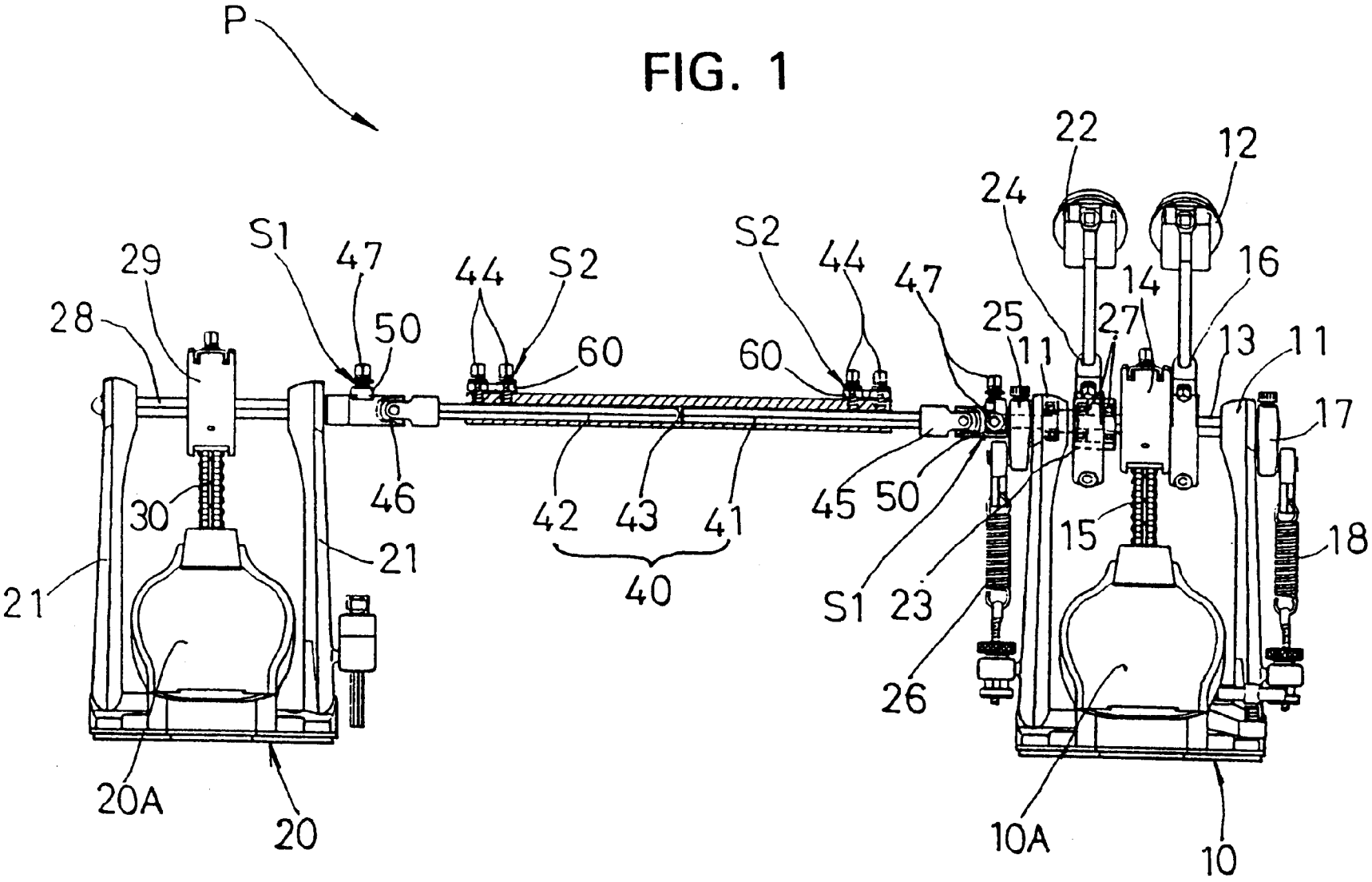
FIG. 1 is a front view in partial cross-section of a dual drum pedal of the invention.
Figure 2:
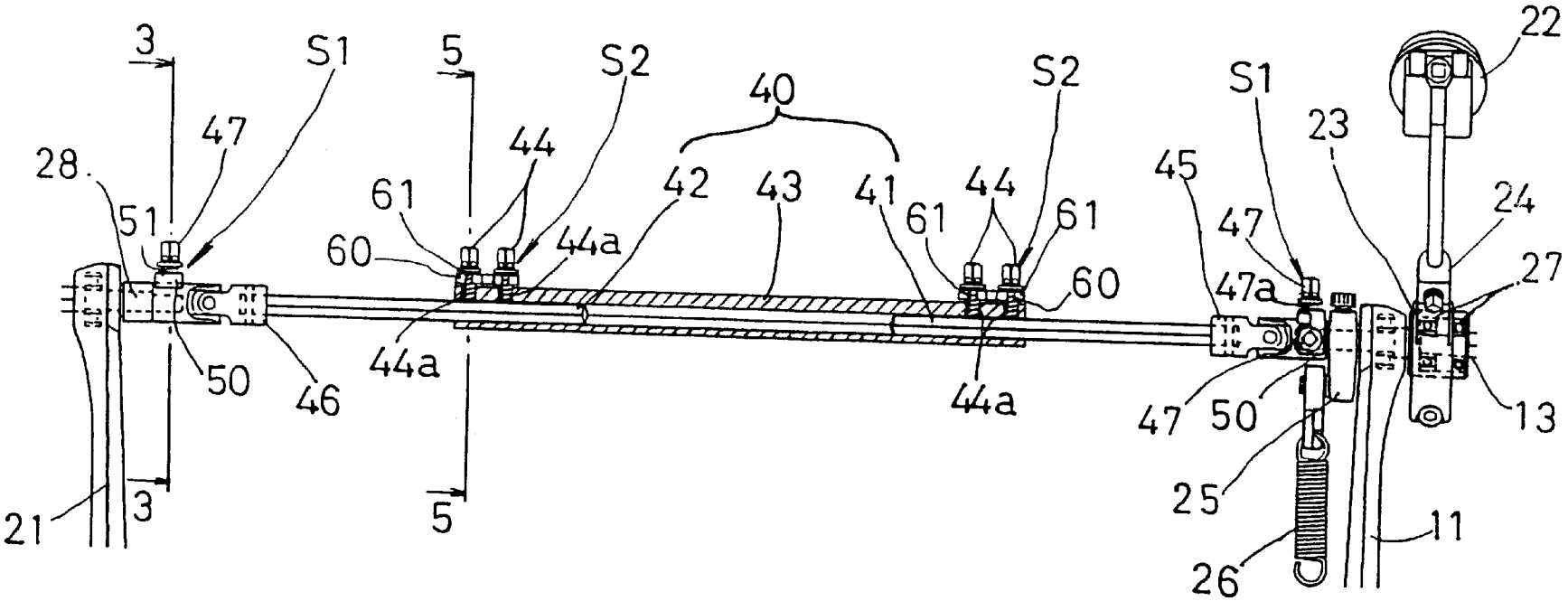
FIG. 2 is an expanded partial view showing essential parts.

The dual drum pedal P shown in FIGS. 1 and 2 has essentially the same construction as the prior art dual drum pedal P1 in FIGS. 7 through 10, except for the structures at the separating parts at the linking rod 40 at S1 and S2. Therefore, the same reference numbers are used without further explanation.

In the dual drum pedal P of the invention, a second beater rotary shaft 23 for the second beater 22 is provided on the first frame 11 of the first pedal 10. The first pedal rotates the first beater rotary shaft 13 for the first beater 12 as described earlier. The second beater rotary shaft 23 at the first pedal 10 is driven by the operating shaft 28 that is rotatably operated by the second pedal 20 on the second frame 21. The rotary shafts 23 and 28 are arranged at a distance by the connecting rod 40. In addition, the dual drum pedal P is so constructed that it can be divided freely through the loosening of the fixing screws 47 and 44, which are placed similarly as in FIG. 8, at the separating parts S1 and S2 at both ends of the rod 40.

Figure 3:
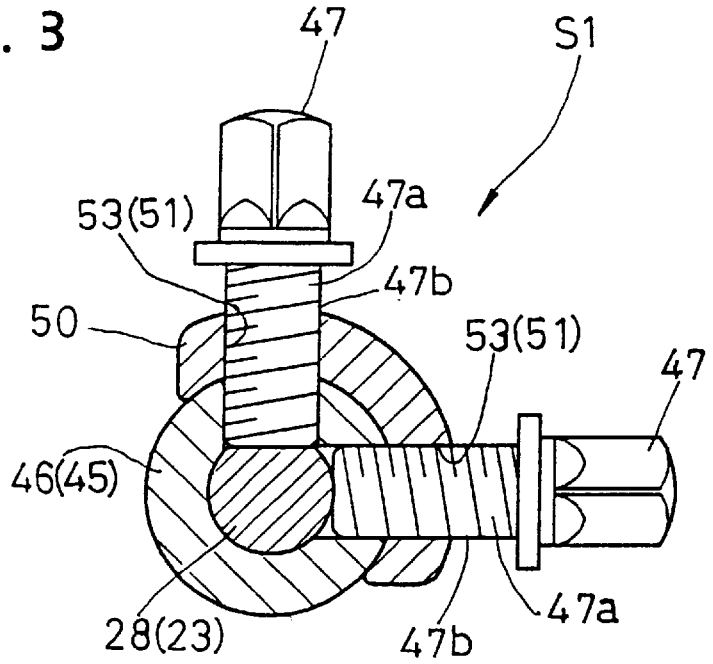
FIG. 3 is a cross-section along line 3—3 in FIG. 2.

As shown in FIG. 3, there is a pair of arcuately spaced apart fixing screws 47 around the shaft 23 or 28 at each universal joint. According to the invention, the fixing screws 47 are installed on the universal joints 45 and 46 and the shafts 23 and 28, not loosely, as in FIGS. 7 and 8, but through the first elastic material seating plate 50, which is made of rubber or plastic, etc. which is located at the separating part S1, as seen in FIG. 3 and which wraps around the exterior of the universal joint. In this example, each first elastic seating plate 50 has an inner surface which has an arcuate curvature that conforms to the outer shape of the respective universal joints 45 and 46, around which each plate 50 is wrapped. When the screws are separated from the universal joints, the plates 50 remain with the screws. Hence, the connections of the universal joints to the rod 40 is through seating plates 50.

Figure 5:
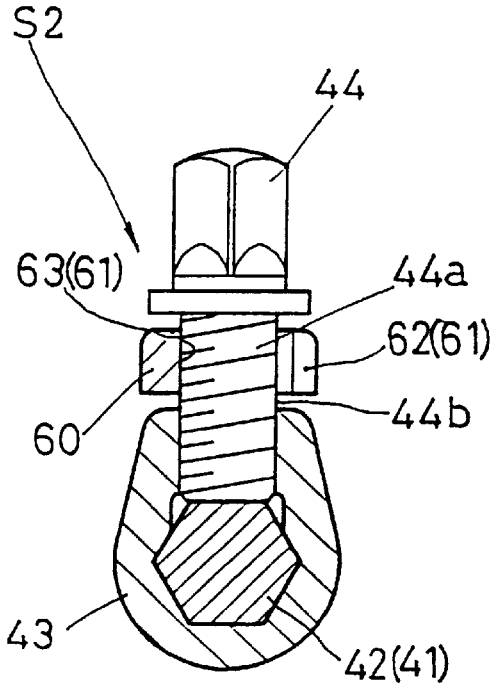
FIG. 5 is a cross-section along line 5—5 in FIG. 2.

At the separating parts S2, the fixing screws 44 are installed at both ends of the main pipe 43 after passing through the second elastic seating plates 60 which are also made of rubber or plastic, etc. as seen in FIG. 5. In this example, further, the second elastic seating plate 60 has a planar shape that corresponds to the shape of the upper surface of the main pipe 43, as shown in FIG. 6.

Figure 4:
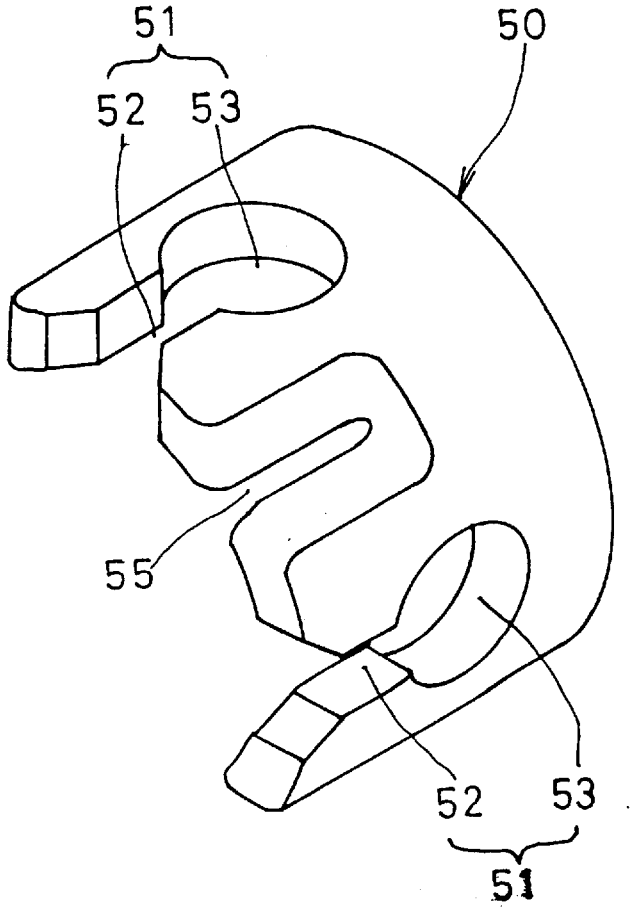
FIG. 4 is an oblique view showing an example of a first elastic seating plate.
Figure 6:
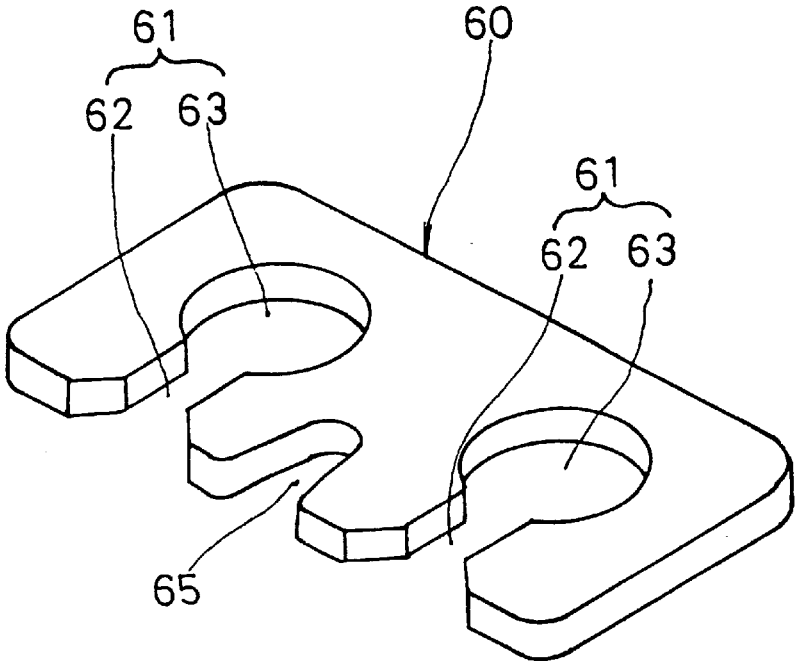
FIG. 6 is an oblique view showing an example of a second of an elastic seating plate.
Figure 7:
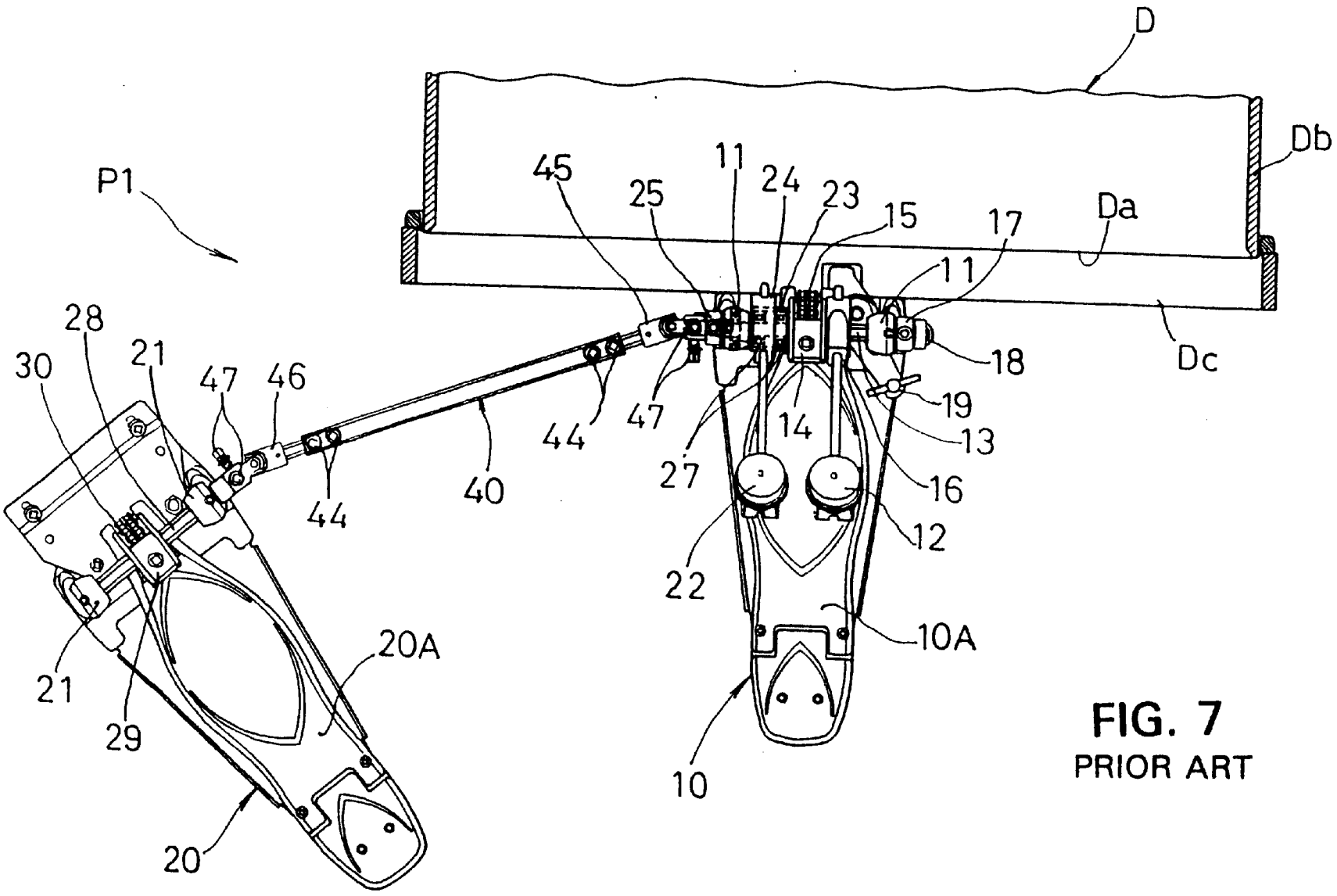
FIG. 7 PRIOR ART
FIG. 7 shows the upper surface of a dual drum pedal according to prior art.
Figure 8:
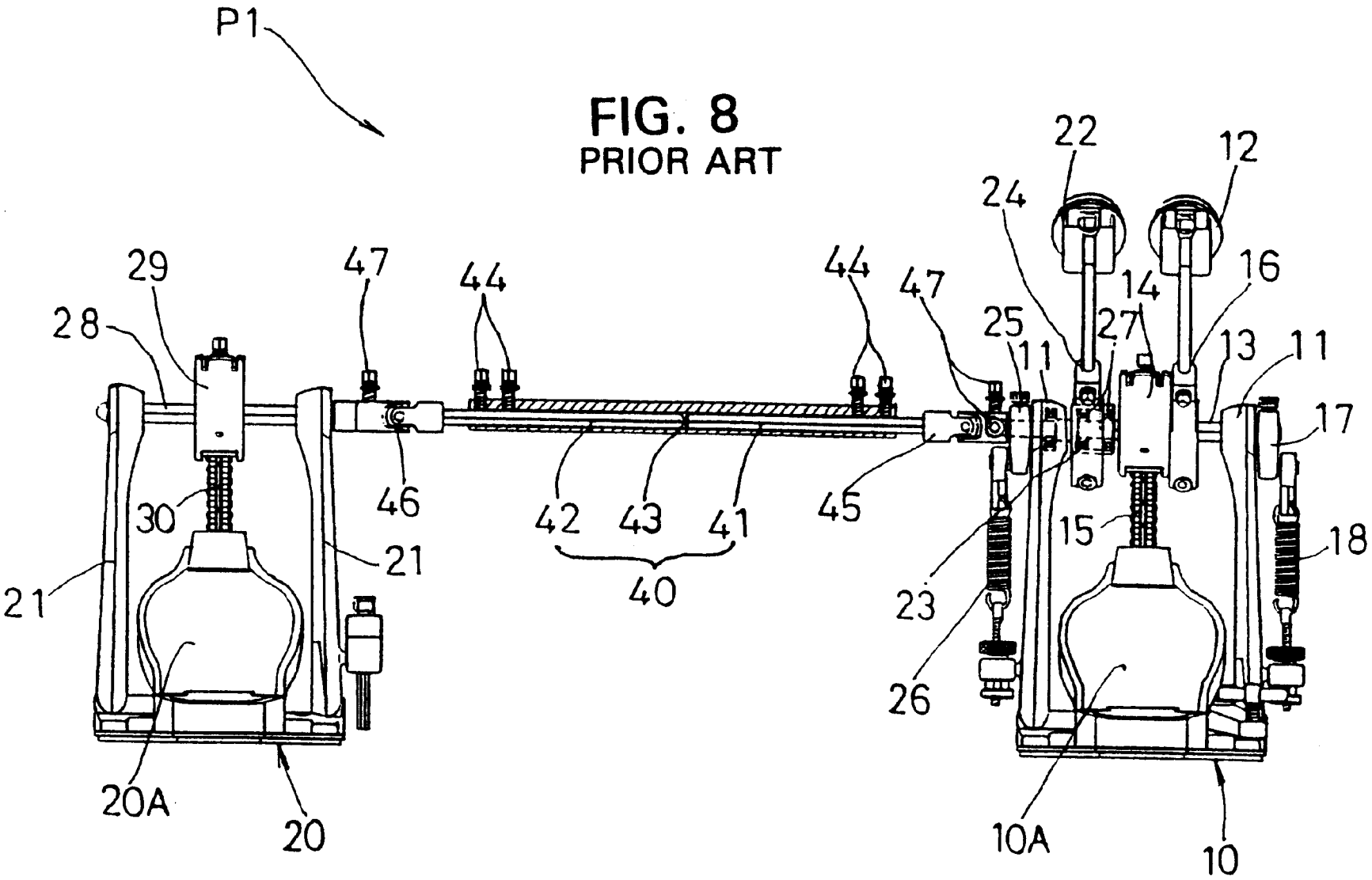
FIG. 8 PRIOR ART
FIG. 8 is a front view of that prior art dual drum pedal, with a part thereof being shown in cross section.

The elastic seating plates 50 and 60 of FIGS. 4 and 6 have respective idling preventive parts 51 and 61 which include the insertion openings 52 and 62 for the compressive insertion of the threaded screw parts 47*a* and 44*a* of the fixing screws 47 and 44 from the sides 47*b* and 44*b* and includes the screw enveloping parts 53 and 63 linked to the insertion openings 52 and 62 and that envelope the screw parts 47*a* and 44*a*.

The screw enveloping parts 53 and 63 have respective inner diameters which are smaller than the outside diameter of the screw parts 47*a* and 44*a* of the fixing screws 47 and 44 but larger than the width of the insertion openings 52 and 62. Because of this, radially inwardly directed pressure is applied by the inner surfaces of the enveloping parts 53 and 63 against the screw parts 47*a* and 44*a* of the remaining fixing screws 47 and 44 after the fixing screws 47 and 44 in the separating parts S1 and S2 have been loosened, as described later. There is resistance, i.e., friction resistance, against the rotation of the fixing screws 47 and 44 in the loosening direction, thereby preventing idling of the fixing screws 47 and 44.

Since the elastic seating plates 50 and 60 have insertion openings 52 and 62 as described, it is possible to compressively insert the screw parts 47*a* and 44*a* of the fixing screws 47 and 44 from the sides 47*b* and 44*b* into the insertion openings 52 and 62 when the dual drum pedal P is assembled.

In this connection, the peripheries of the insertion openings 52 and 62 are elastically deformed so as to expand the insertion openings 52 and 62. This makes it possible to compressively insert the screw parts 47*a* and 44*a* of the fixing screws 47 and 44 into the insertion openings 52 and 62 from the sides 47*b* and 44*b*, thereby installing the elastic seating plates 50 and 60 by enveloping them at the screw enveloping parts 53 and 63. This enables the dual drum pedal P to be easily assembled.

In this embodiment, the elastic seating plate 50 (60) has two idling preventive parts 51 (61) for the two fixing screws 47 (44). There is a deformable cut part 55 (65) formed between the two idling-preventive parts 51 (61).

With two idling preventive parts 51 (61) at the elastic seating plate 50 (60) as described above, after the loosening of the fixing screws 47 (44), even if one fixing screw and the elastic seating plate might rotate together, that rotation can be prevented by the other fixing screw.

The cut part 55 (65), which is capable of being deformed, between the two idling preventive parts 51 (61) as described above, is effective during the compressive insertion of the screw part 47*a* (44*a*) of the fixing screw 47 (44) into the insertion opening 52 (62) from its side 47*b* (44*b*), to enable the peripheries of the insertion openings 52 (62) to elastically deform so as to smoothly expand the openings 52 (62), thereby making it possible to smoothly insert the fixing screws 47 (44) into the insertion openings 52 (62). As a result, the operability for the installation of the dual drum pedal P can be improved.

Figure 9:
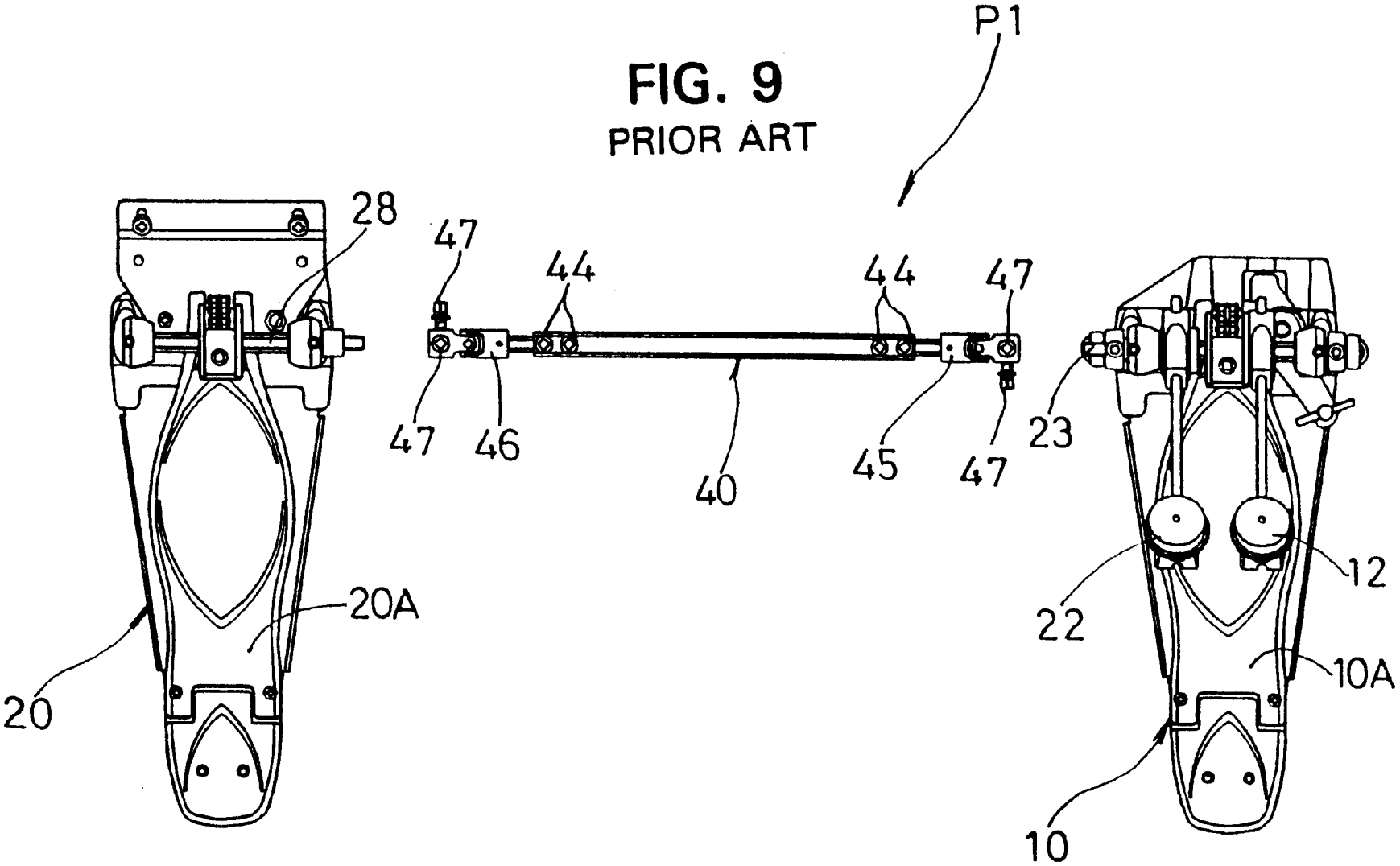
FIG. 9 PRIOR ART
FIG. 9 is an upper surface view of a prior art example when the dual drum pedal has been divided.
Figure 10:
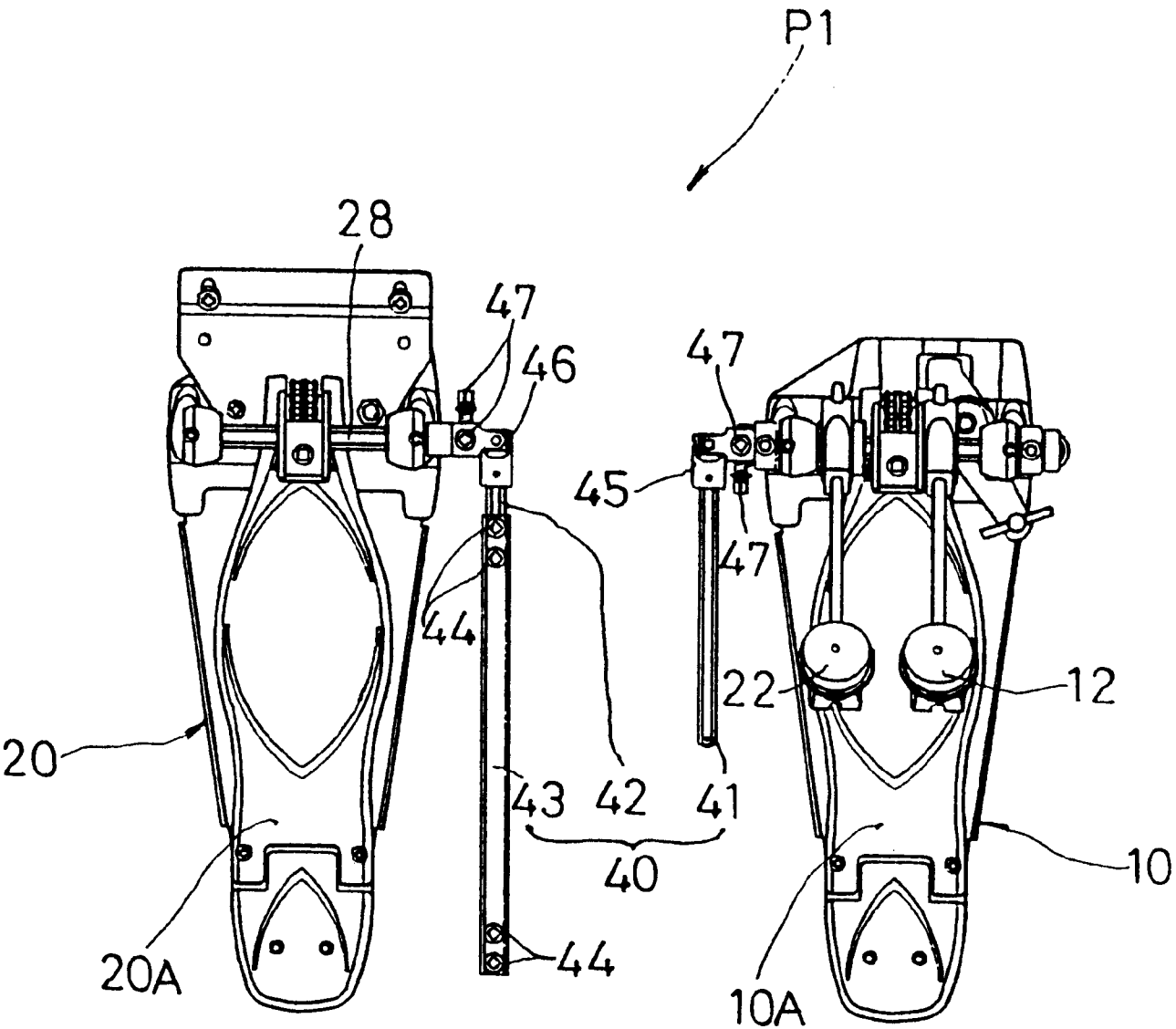
FIG. 10 PRIOR ART
FIG. 10 is an upper surface view of the prior art indicating an example of the drum pedal having another division.

The dual drum pedal P having the connecting construction of the linking rod member can be divided in two or three parts at the separating parts S1 or S2, as is shown in FIG. 9 or 10 in connection with the explanation of the conventional technology. As was pointed out as to the prior art design, moreover, the fixing screws 47 and 44 remain screwed to the separating parts S1 and S2.

Here, the fixing screws 47 and 44 that have remained in the separating parts S1 and S2 as they were loosened as described earlier receive inwardly directed pressure from the inner walls of the screw enveloping parts 53 and 63 of the idling preventive parts 51 and 61 of the elastic seating plates 50 and 60 (resistance against idling) at the screw parts 47*a* and 44*a*. This, in turn, holds the plates 50 and 60 to the respective screws. Therefore, there is no possibility for idling due to the vibrations or shocks received during the movement or transportation by a vehicle, etc. This can prevent the fixing screws 47 and 44 from being dropped and lost from the separating parts S1 and S2.

In the connecting structure of the connective rod member in the dual drum pedal of the invention, the fixing screws are installed through respective elastic seating plates which are equipped with an idling preventive part. This makes it possible, by an extremely simple construction, to prevent idling of a fixing screw that remains in the separating part and prevents the screw possibly falling out and being lost during transportation, etc.

At the idling preventive part of the elastic seating plate, the insertion hole for compressive insertion from the side of the screw part of the fixing screw is continuous with the screw enveloping part. This makes it possible to install the elastic seating plate after the installation of the fixing screws at the separating part at the time of assembly, thereby making it possible to easily assemble the dual drum pedal.

If the elastic seating plate includes two idling-preventive parts for the two fixing screws, even if one fixing screw and the elastic seating plate could start rotating together after the loosening of the fixing screws, that rotation can be prevented by the other one of the fixing screws.

If a cut region of the plate that can be deformed is formed between the two idling preventive parts, it becomes possible to compressively insert the screw parts of the fixing screws smoothly into the insertion openings of the idling-preventive parts, which makes it easier to assemble the dual drum pedal.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A connecting structure for connecting two rods, wherein the rods include a first inner rod, a second outer rod with a bore along its length, the first rod being installed inside the bore extending through second outer rod; the connecting structure comprising a threaded bore radially through the outer second rod and communicating to the inner first rod;

a fixing screw threadedly installed in the threaded bore in the second rod and tightenable against the first rod;

an elastic seating plate located on the threaded screw radially outward of the second outer rod, the elastic seating plate having a side edge, a fixing screw insertion opening extending in from the side edge of the plate, the insertion opening being narrower than the screw for causing the plate to be compressed at the insertion opening during insertion of the screw through and along the length of the insertion opening in from the edge of the plate; an enveloping part of the seating plate communicating with the insertion opening and being shaped for enveloping the screw, whereby upon separation of the screw from the outer second rod, the screw may be held supported in the enveloping part of the seating plate.

2. The connecting structure of claim 1, further comprising two of the radial, threaded bores into the second rod at circumferentially spaced apart locations around the second rod, and a respective one of the fixing screws in each of the bores;

the elastic seating plate having a respective one of the insertion openings at each of the fixing screws and a respective one of the enveloping parts communicating with each of the insertion openings, each of the enveloping parts enveloping the respective screw whereby the screws may be supported in the seating plate when the screws are removed from the respective bores.

3. The connecting structure of claim 2, further comprising a deformable section of the seating plate between the first and second insertion openings and between the first and second enveloping parts for enabling deformation of the seating plate around the second outer rod.

4. The connecting structure of claim 3, wherein the deformable section comprises a cut in from the side edge of the seating plate for enabling its deformation around the second outer rod.

5. The connecting structure of claim 2, wherein the elastic seating plate is comprised of elastic material and the enveloping part is shaped to envelope the respective screw.

6. The connecting structure of claim 5, wherein the enveloping parts of the seating plate each include an opening with a diameter smaller than the outside diameter of the respective screw and the insertion opening is of narrower width than the diameter of the enveloping parts.

7. In combination, the connecting structure of claim 2, and a dual drum pedal comprising a first pedal operable for operating a first drum beater, a first drum beater connected with the first pedal such that operating the first pedal operates the first beater, a second pedal operable for operating a second drum beater, second drum beater connected with the second pedal such that operating the second pedal operates the second beater; and a connecting rod between the second pedal and the second drum beater, wherein the connecting rod includes the first inner rod and the second outer rod thereon and the connecting structure is disposed on the first and second rods.

8. The combination of claim 7, wherein there are two of the first inner rods respectively movable toward and away from each other, a single one of the outer rods encompassing both of the inner rods so that the inner rods can be movable toward and away from each other within the outer rod; and a respective one of the connecting structures between the outer rod and each of the inner rods.

9. The connecting structure of claim 1, wherein the elastic seating plate is comprised of elastic material and the enveloping part is shaped to envelope the respective screw.

10. The connecting structure of claim 9, wherein the enveloping part of the seating plate includes an opening with a diameter smaller than the outside diameter of the respective screw and the insertion opening is of narrower width than the diameter of the enveloping part.

* * * * *